US006386947B2

(12) United States Patent
Donohue

(10) Patent No.: US 6,386,947 B2
(45) Date of Patent: May 14, 2002

(54) METHOD AND APPARATUS FOR DETECTING WAFER SLIPOUTS

(75) Inventor: Timothy J. Donohue, Menlo Park, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/741,414

(22) Filed: Dec. 19, 2000

Related U.S. Application Data

(60) Provisional application No. 60/185,787, filed on Feb. 29, 2000.

(51) Int. Cl.[7] ..... B24B 49/00

(52) U.S. Cl. ..... 451/8; 451/285

(58) Field of Search ..... 451/6, 8, 9, 10, 451/11, 41, 285, 286, 287, 288, 290, 385, 397, 398

(56) References Cited

U.S. PATENT DOCUMENTS

| | | | |
|---|---|---|---|
| 3,374,582 | A | 3/1968 | Boettcher |
| 3,698,776 | A | 10/1972 | Litman et al. |
| 3,731,435 | A | 5/1973 | Boettcher et al. |
| 3,781,071 | A | 12/1973 | Kauzlarich |
| 3,977,130 | A | 8/1976 | Degner |
| 4,373,991 | A | 2/1983 | Banks |
| 4,918,868 | A | 4/1990 | Barth et al. |
| 5,081,795 | A | 1/1992 | Tanaka et al. |
| 5,193,316 | A | 3/1993 | Olmstead |
| 5,205,082 | A | 4/1993 | Shendon et al. |
| 5,230,184 | A | 7/1993 | Bukhman |
| 5,423,558 | A | 6/1995 | Koeth et al. |
| 5,423,716 | A | 6/1995 | Strasbaugh |
| 5,441,444 | A | 8/1995 | Nakajima |
| 5,443,416 | A | 8/1995 | Volodarsky et al. |
| 5,449,316 | A | 9/1995 | Strasbaugh |
| 5,476,414 | A | 12/1995 | Hirose et al. |
| 5,498,199 | A | 3/1996 | Karlsrud et al. |
| 5,584,751 | A | 12/1996 | Kobayashi et al. |
| 5,618,227 | A | 4/1997 | Tsutsumi et al. |
| 5,624,299 | A | 4/1997 | Shendon |
| 5,643,053 | A | 7/1997 | Shendon |
| 5,681,215 | A | 10/1997 | Sherwood et al. |
| 5,733,171 | A | 3/1998 | Allen et al. |
| 5,762,544 | A | 6/1998 | Zuniga et al. |
| 5,823,853 | A | 10/1998 | Bartels et al. |

(List continued on next page.)

FOREIGN PATENT DOCUMENTS

| | | |
|---|---|---|
| DE | 86 31 087.9 | 11/1986 |
| EP | 0 156 746 A1 | 10/1985 |
| EP | 0 653 270 A1 | 5/1995 |
| EP | 0 841 123 A1 | 5/1998 |
| JP | 61-25768 | 2/1986 |
| JP | 63-114870 | 5/1988 |
| JP | 63-300858 | 12/1988 |
| JP | 1-216768 | 8/1989 |
| JP | 2-224263 | 9/1990 |
| JP | 5-69310 | 3/1993 |
| WO | 96/36459 | 11/1996 |

OTHER PUBLICATIONS

U.S. application No. 08/861,260, Zuniga et al., filed May 21, 1997.

*Primary Examiner*—Timothy V. Eley
*Assistant Examiner*—Dung Van Nguyen
(74) *Attorney, Agent, or Firm*—Moser, Patterson & Sheridan

(57) ABSTRACT

A method and apparatus for detecting the disengagement of a workpiece from a polishing head is provided. In one embodiment, the apparatus generally includes a polishing head and a detector. The polishing head has a fixed portion and a first portion. The detector is adapted to provide a metric indicative of relative motion between the fixed portion and the first portion.

27 Claims, 3 Drawing Sheets

U.S. PATENT DOCUMENTS 5,834,645 A 11/1998 Bartels et al.
5,899,798 A 5/1999 Trojan et al.
5,957,751 A 9/1999 Govzman et al.
5,961,369 A 10/1999 Bartels et al.
6,132,289 A * 10/2000 Labunsky et al. ..... 451/6
6,152,808 A * 11/2000 Moore ..... 451/60
6,267,642 B1 * 7/2001 Vogtmann et al. ..... 451/8
6,280,291 B1 * 8/2001 Gromko et al. ..... 451/8

* cited by examiner

METHOD AND APPARATUS FOR DETECTING WAFER SLIPOUTS

This application claims benefit of U.S. Provisional Patent Application Ser. No. 60/185,787, filed Feb. 29, 2000, which is hereby incorporated herein by reference in its entirety.

BACKGROUND OF THE DISCLOSURE

1. Field of the Invention

Embodiments of the invention generally relate to a method and apparatus for detecting wafer slipouts from a polishing head.

2. Background of the Invention

In semiconductor wafer processing, the use of chemical mechanical planarization, or CMP, has gained favor due to the enhanced ability to increase device density on a semiconductor workpiece, or substrate, such as a wafer. Chemical mechanical planarization systems typically include a polishing head and a platen that supports a polishing material. The polishing head generally includes a ring that circumscribes a substrate receiving pocket in which the substrate is retained during processing. Processing of the substrate is generally performed by providing relative motion between the substrate and the polishing material in the presence of a polishing fluid while pressing the substrate against the polishing material.

During polishing, frictional forces between the substrate and the polishing material causes the substrate to be forced laterally against the ring of the polishing head. Occasionally, a triggering event causes the retainment of the substrate within the polishing head to become partially or completely lost. For example, some of the pressure biasing the ring towards the polishing material may be lost, thus diminishing the force capturing the substrate between the polishing head and the polishing material. If the pressure is sufficiently reduced, the lateral force of the substrate against the ring may cause the ring to lift thus allowing the substrate to escape from under the polishing head. Other triggering events may include passing the substrate over a polishing surface abnormality such as wrinkles in the polishing material and run-out in the parallelism between the polishing head and platen.

Once the wafer has slipped out from under the polishing head, the substrate may be scratched or broken. Additionally, if the slipout event is not timely detected, valuable production time is lost while the damaged wafer waiting to be removed from the polisher. Additionally, the non-retained wafer left in the processing area may damage the tool or tool components such as sensors or wiring.

Therefore, there is a need for a method and apparatus for detecting wafer slipouts.

SUMMARY OF THE INVENTION

In one aspect of the invention, an apparatus for detecting disengagement of a workpiece is provided. In one embodiment, the apparatus includes a polishing head and a detector. The polishing head has a first portion and a second portion. The detector is adapted to provide a metric indicative of relative motion between the first portion and the second portion.

In another aspect of the invention, a method for detecting disengagement of a workpiece from a polishing head is provided. In one embodiment, the method includes the steps of pressing the workpiece retained in the polishing head against a polishing material, providing relative motion between the workpiece and the polishing material, and detecting motion of the polishing head in a direction normal to the polishing material.

BRIEF DESCRIPTION OF THE DRAWINGS

The teachings of the present invention can be readily understood by considering the following detailed description in conjunction with the accompanying drawings, in which.

To facilitate an understanding, identical reference numerals have been used, wherever possible, to designate identical elements that are common to the figures.

DETAILED DESCRIPTION OF INVENTION

Figure 1:
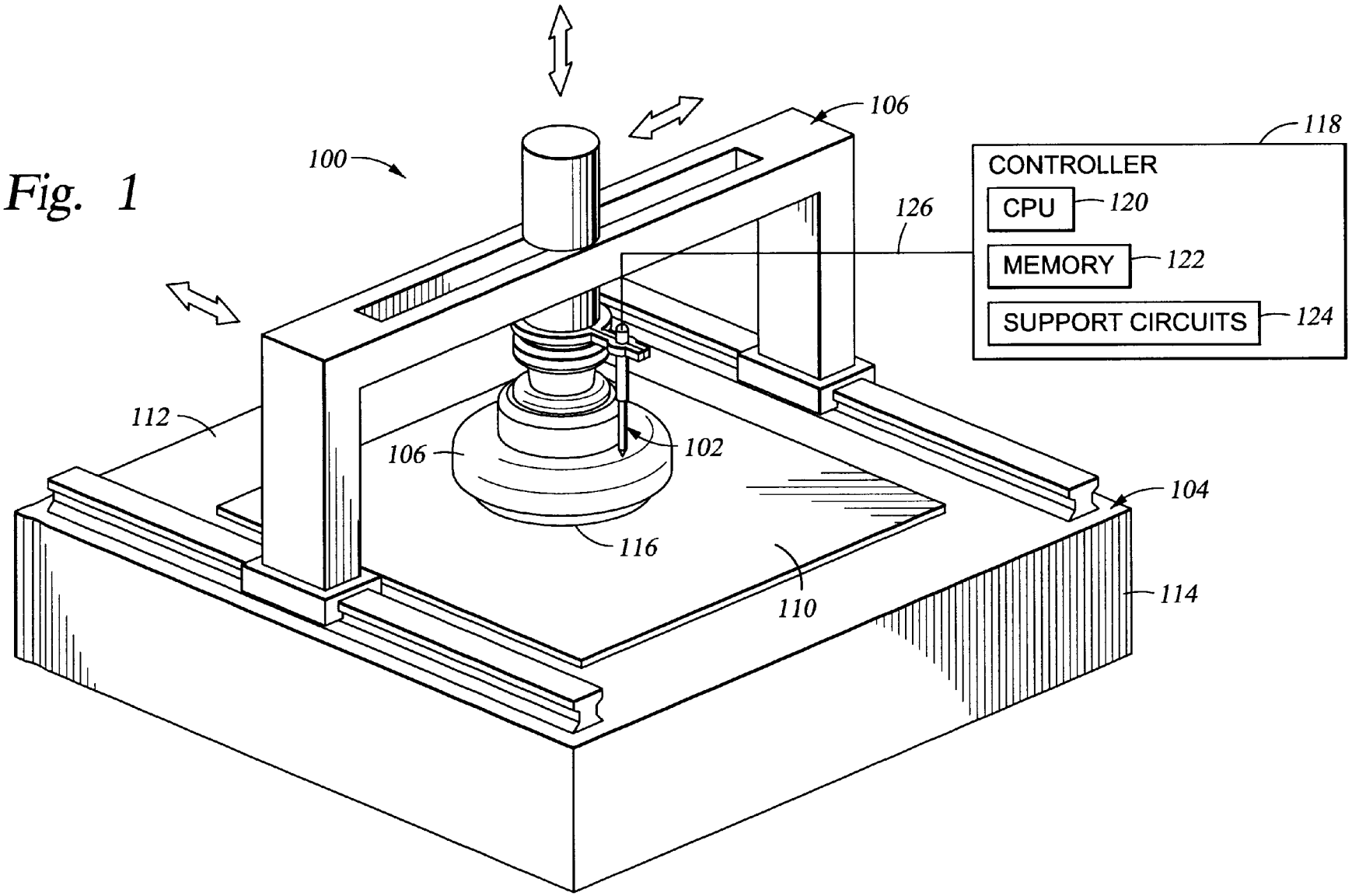
FIG. 1 depicts an illustrative polishing system having one embodiment of a slipout detection mechanism.

FIG. 1 is a perspective view of an exemplary chemical mechanical polishing system 100 having one embodiment of a slipout detection mechanism (slipout detector) 102 coupled thereto. Although the slipout detector 102 is described in reference to one embodiment of a chemical mechanical polishing system 100, the slipout detector 102 may readily be adapted to other chemical mechanical polishing systems that utilize a polishing head to retain a substrate against a polishing surface.

Generally, the exemplary polishing system 100 includes a polishing table (platen) 104, a drive system 106 and a polishing head 108. The platen 104 generally has a polishing material 110 disposed on a top surface 112. The platen 104 may include a subpad (not shown) disposed in the top surface 112 beneath the polishing material 110 to maintain an effective modulus of the polishing material 110, subpad and platen 104 stack at a predetermined value that produces a desired polishing result. The platen 104 is typically stationary. Alternatively, the platen 104 may move, for example, rotating about a central axis.

The drive system 106 is coupled to a base 114 and supports the polishing head 108 above the polishing material 110. Generally, the drive system 106 provides x/y motion to the polishing head 108 so that a substrate 116 retained in the polishing head 108 is moved in a programmed pattern while pressing the substrate 116 against the polishing material 110.

The polishing head 108 may be actuated to move along an axis normal to the polishing material 110 so that the substrate 116 may contact or be moved clear of the polishing material 110. Examples of polishing heads that may be utilized in accordance with the invention are the DIAMOND HEAD™ wafer carrier and the TITAN HEAD™ wafer carrier, both available from Applied Materials, Inc. of Santa Clara, Calif.

To facilitate process control, a controller 118 comprising a central processing unit (CPU) 120, support circuits 124 and memory 122, is coupled to the system 100. The CPU 120 may be one of any form of computer processor that can be used in an industrial setting for controlling various drives and pressures. The memory 122 is coupled to the CPU 120. The memory 122, or computer-readable medium, may be one or more of readily available memory such as random access memory (RAM), read only memory (ROM), floppy disk, hard disk, or any other form of digital storage, local or remote. The support circuits 124 are coupled to the CPU 120 for supporting the processor in a conventional manner. These circuits include cache, power supplies, clock circuits, input/output circuitry, subsystems, and the like.

The slipout detector 102 is generally positioned above the polishing head 108. The slipout detector 102 has a lead 126 that couples the detector to the controller 118. The slipout detector 102 generally senses an indicia indicating movement of the polishing head 108 in a direction normal to a plane defined by the polishing material 110. As the polishing head 108 and substrate 116 are moved across the polishing material 110, the polishing head 108 generally experiences small movements in the normal direction. These movements are generally due to non-uniformities present in the polishing material 110, the top surface 112 of the base 114, vibrations and the like. The slipout detector 102 generally provides the controller 118 with a signal indicative of the movement of the polishing head 108 over these irregularities. The controller 118 utilized the signal to establish a baseline that is indicative of the normal range of motion of the polishing head 108 across the polishing material 110 during normal processing. Once this baseline is established, the controller 118 can detect when a signal from the slipout detector 102 falls outside of a process window established using the baseline, such as the substrate 116 slipping out from under the polishing head 108.

Figure 2:
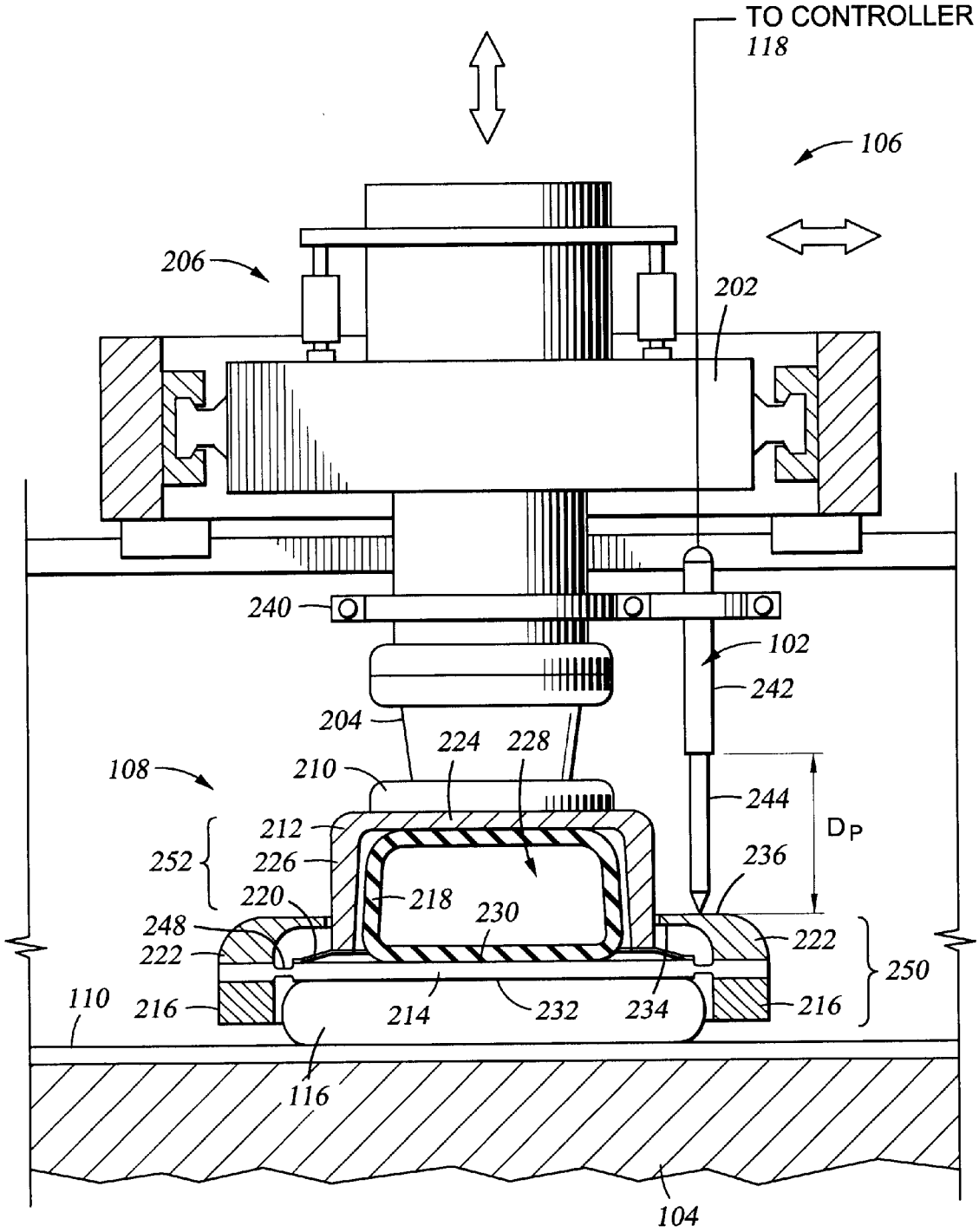
FIG. 2 depicts one embodiment of a slipout detection mechanism coupled to a polishing head.

FIG. 2 depicts one embodiment of the polishing head 108 interfaced with an embodiment of the slipout detector 102. Generally, the polishing head 108 is disposed between a movable stage 202 of the drive system 106 and the platen 104. The polishing head 108 is coupled to a lower end 210 of the column 204 that extends between the stage 202 toward the polishing material 110. The column 204 generally includes an actuator 206 that facilitates movement of the polishing head 108 along the axis normal to the polishing material 110. In one embodiment, the column 204 is coupled to a pair of linear actuators such as a ball screws that provides controllable motion of the column 204 and polishing head 108 normal to the polishing material 110. Alternatively, other types of actuators may be utilized, such as solenoids, lead screws, pneumatic cylinders, hydraulic cylinders and the like.

In one embodiment, the polishing head 108 includes a first portion 250 and a second portion 252 that are movable relative each other. Generally, the first portion 250 includes a retaining ring 216 and a cover 222. The second portion 252 typically includes a housing 212, a carrier plate 214, a biasing device 218 and a gimbal 220. The housing 212 has a center portion 224 and an extending lip 226 that defines a space 228 therebetween. The center portion 224 of the housing 212 is coupled to the lower end 210 of the column 204. A first side 230 of the carrier plate 214 is disposed adjacent to the lip 226 of the housing 212. A second side 232 of the carrier plate 212 typically applies pressure to the substrate 116 during processing (i.e., presses the substrate 116 against the polishing material 110).

The gimbal 220 is coupled between the carrier plate 214 and the lip 226 of the housing 212. The gimbal 220 allows the carrier plate 214 to pivot relative the housing 212, thus allowing the carrier plate 214 and substrate 116 to follow the contours of the polishing material 110. Thus, as the drive system 106 moves the polishing head 108 across the surface of the polishing material 110, the gimbal 220 allows the carrier plate 214 and substrate 116 to maintain a substantially parallel alignment with the surface of the polishing material 110. In one embodiment, the gimbal 220 comprises a metallic flexure.

The carrier plate 214 additionally includes a flexure 248 extending from the perimeter of the carrier plate 214 to the retaining ring 216. The flexure 248 allows the retaining ring 216 to move relative the housing 212, thus allowing the first portion 250 of the polishing head 108 to move normally relative to the second portion 252 and the polishing material 110 during polishing.

The retaining ring 216 is disposed at the carrier plate's perimeter to prevent the substrate 116 from slipping out from under the polishing head 108 during processing. Generally, the retaining ring 216 is comprised of a polymeric material 110 that is typically placed in contact with the polishing material 110 during processing.

The cover 222 is coupled to the retaining ring 216. The cover 222 generally has a central opening 234 that allows the housing 212 to extend therethrough. The cover 222 additionally includes an upper surface 236 that is generally parallel to the carrier plate 214.

Disposed between the carrier plate 214 and the housing 212 is the biasing device 218. The biasing device 218 generally provides a controllable force that urges the carrier plate 214 away from the housing 212 so that the substrate 116 is pressed against the polishing material 110. In one embodiment, the biasing device 218 is inflatable bellows. Alternatively, the biasing device 218 may comprise other force generating mechanisms such as a linear actuator, for example, a pneumatic cylinder or lead screw.

The slipout detector 102 generally detects motion of the polishing head 108 relative to the platen 104. In one embodiment, the slipout detector 102 is coupled to the second portion 252 of the polishing head 108. As the second portion 252 is held at a predetermined distance from the polishing material 110 during polishing, other portions of the system 100 that are also held at a fixed distance from the polishing material 110 may equally provide a reference point to determine the relative normal motion of the first portion 250. As such, the slipout detector 102 may alternatively be support from portions of the system 100 that fixed in distance to the polishing material 110 during processing. Optionally, the slipout detector 102 may be coupled to the first portion 250 of the polishing head 108 to reference the change in position of other portions of the system 100 relative thereto.

In one embodiment, the slipout detector 102 is coupled to the column 204 supporting the polishing head 108. Typically, the slipout detector 102 is coupled to the column 204 by a bracket 240. The bracket 240 generally comprises an aluminum or polymer clamp that holds the slipout detector 102 in a position offset to a center line of the polishing head 108 and above the first portion 250 of the polishing head 108.

The slipout detector 102 provides a signal to the controller 118 in response to changes in a metric indicative of the motion of the polishing head 108. In one embodiment, the slipout detector 102 comprises a linear voltage displacement transducer (LVDT). The transducer generally includes a sensor body 242 having a piston 244 extending therefrom. The sensor body 242 generally is held by the bracket 240 and orientated over the housing 212 such that the piston 244 is in contact with the upper surface 236 of the cover 222 when the polishing head 108 is lowered to a position where the substrate 116 is in contact with the polishing material 110. Thus, when the system 100 is processing the substrate 116, a process window indicative of the normal distance between the cover 222 and the sensor body 242 may be complied by the controller 118 as the substrate 116 is processed.

For example, as the piston 244 moves in relation to the sensor body 242, the signal provided by the detector 102 is indicative of the distance between the cover 222 (or other first portion 250 of the polishing head 108) and the sensor body 242. As the first portion 250 of the polishing head 108 moves in relation to the sensor body 242, the baseline (i.e., the minimum maximum range of normal relative motion) between the cover 222 and the detector 102 may be determined by the controller 118, which is used to establishing the process window. For simplicity of illustration, the process window is depicted as $D_p$. Alternatively, the process window may be set as a predetermined value.

Figure 3:
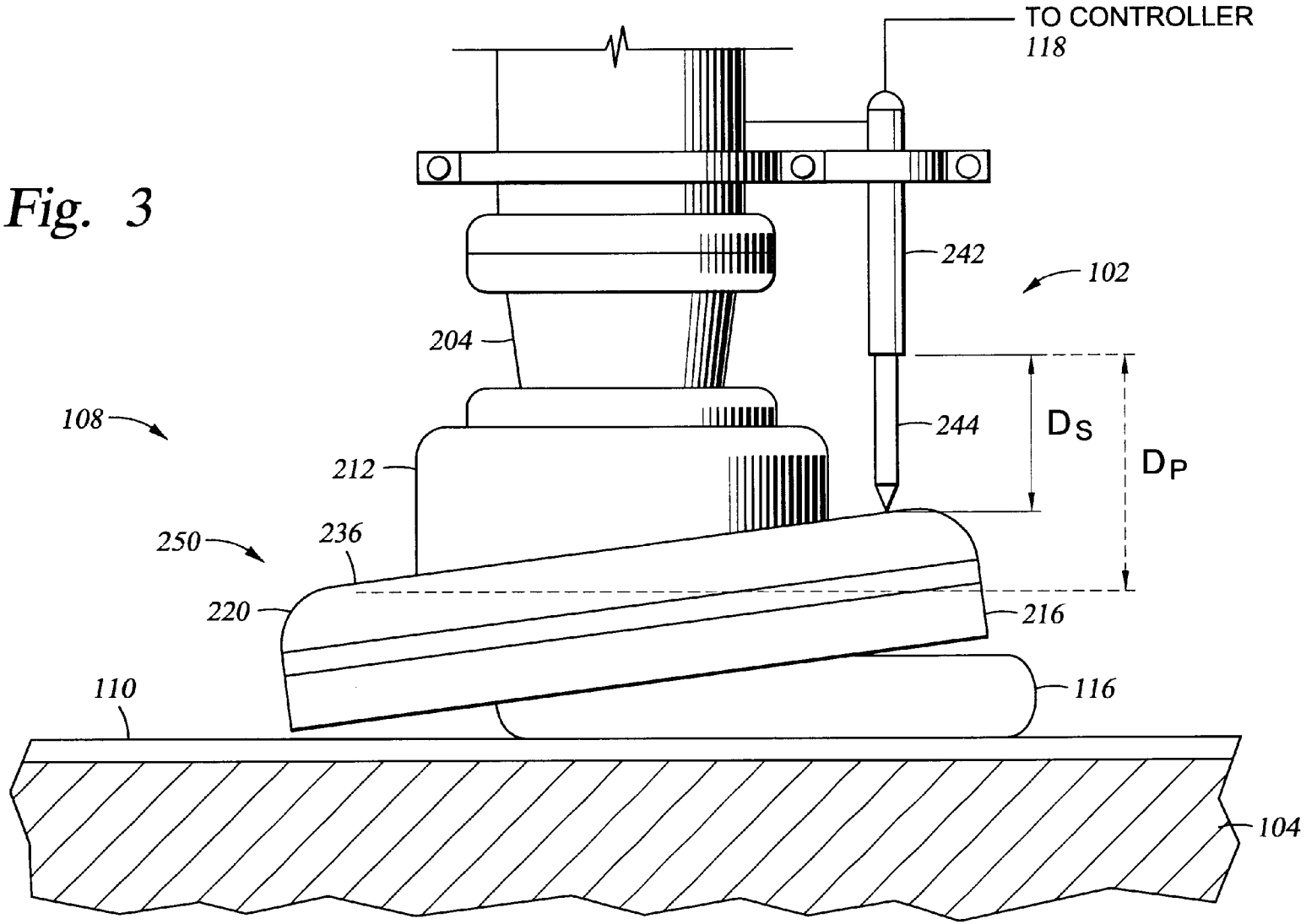
FIG. 3 depicts the polishing head of FIG. 2 having a substrate in a slipout condition.

Thus, in the event that the substrate 116 becomes disengaged from the polishing head 108 as depicted in FIG. 3, the first portion 250 of the polishing head 108 is moved away from the polishing material 110 as the wafer substrate 116 slides between the retaining ring 216 and the polishing material 110. As the first portion 250 of the polishing head 108 is forced upward, the piston 244 is correspondingly moved further into the detector 102 such as the distance between the sensor body 242 and the cover 222 is now $D_s$.

The controller 118 receives the signal from the detector 102 indicating that the distance $D_s$ lies beyond the process window $D_p$. The controller 118 then indicates that the substrate 116 has become disengaged from the polishing head 108. The system 100 may then be shut down to remove the substrate 116 or other actions may be alternatively taken.

As the slipout detector 102 provides a metric indicative of the motion of the first portion 250 of the polishing head 108, it is contemplated that other sensing means may be utilized in place of the LVDT transducer. For example, other sensing means that may be utilized as slipout detectors include accelerometers, limit switches, proximity sensor, optical encoders, Hall effect sensors, reed switches and like sensors.

Although the teachings of the present invention that have been shown and described in detail herein, those skilled in the art can readily device other varied embodiments that still incorporate these teachings and do not depart from the scope and spirit of the invention.

What is claimed is:

1. Apparatus for detecting disengagement of a workpiece comprising:

a polishing head having a first portion and a second portion; and a detector adapted to provide a metric indicative of relative motion between the first portion and the second portion.

2. The apparatus of claim 1, wherein the detector is an accelerometer, a limit switch, a proximity sensor, a Hall effect sensor, an optical encoder or a reed switch.

3. The apparatus of claim 1, wherein the detector is a linear voltage displacement transducer.

4. The apparatus of claim 3, wherein the transducer further comprises:

a sensor body; and a piston extending movably from the sensor body and in contact with the first portion.

5. The apparatus of claim 1 further comprising:

a column supporting the polishing head; and a bracket coupling the detector to the column.

6. The apparatus of claim 1, wherein the first portion comprises at least a carrier plate, a cover or a retaining ring.

7. The apparatus of claim 1, wherein the first portion comprises a cover having a surface adapted to interface with the detector.

8. The apparatus of claim 1, wherein the polishing head further comprises a flexure coupling the second portion to the first portion.

9. The apparatus of claim 8, wherein the flexure is coupled between a retaining ring and the second portion.

10. The apparatus of claim 1, wherein the polishing head further comprises a biasing device disposed between the first portion and the second portion.

11. The apparatus of claim 1, wherein the metric is a change in voltage.

12. The apparatus of claim 1, wherein the first portion moves in response to movement of the workpiece normal to a polishing material as the workpiece is polished on the polishing material.

13. Apparatus for detecting disengagement of a workpiece comprising:

a polishing material;

a polishing head for retain the workpiece against the polishing material during polishing; and a detector adapted to provide a metric indicative of relative motion between the polishing material and the polishing head.

14. The apparatus of claim 13, wherein the detector is a linear voltage displacement transducer, an accelerometer, a limit switch, a proximity sensor, a Hall effect sensor, an optical encoder or a reed switch.

15. Apparatus for detecting disengagement of a workpiece comprising:

a polishing head having a first portion and a second portion; and a means for detecting relative motion between the first portion and the second portion.

16. The apparatus of claim 15, wherein the means for detecting is an accelerometer, a limit switch, a proximity sensor, a Hall effect sensor, an optical encoder, linear voltage displacement transducer or a reed switch.

17. Apparatus for detecting disengagement of a workpiece comprising:

a platen;

a polishing material disposed on the platen;

a polishing head supported above the polishing material, the polishing head having a first portion and a second portion; and a detector adapted to provide a metric indicative of motion between the first portion and the second portion.

18. The apparatus of claim 17, wherein the platen is stationary.

19. The apparatus of claim 17, wherein the platen rotates.

20. The apparatus of claim 17, wherein the polishing head moves laterally relative to the platen during processing.

21. A method for detecting disengagement of a workpiece from a polishing head comprising:

pressing the workpiece retained in the polishing head against a polishing material;

providing relative motion between the workpiece and the polishing material; and detecting motion of the polishing head in a direction normal to the polishing material.

22. The method of claim 21, wherein the step of detecting motion further comprises the step of moving a first portion of the polishing head relative to a second portion.

23. The method of claim 22, wherein the step of detecting motion further comprises establishing a baseline or process window.

24. The method of claim 23, wherein the step of detecting motion further comprises the step of detecting motion of the first portion outside of the process window.

25. The method of claim 21, wherein the step of detecting motion further comprises the step of moving a piston coupled to a sensor.

26. The method of claim 25, wherein the sensor is a linear voltage displacement transducer.

27. The method of claim 21, wherein the step of providing relative motion between the workpiece and the polishing material further comprises the step of polishing the workpiece.

* * * * *